US010139098B2

(12) United States Patent
Jelinek et al.

(10) Patent No.: US 10,139,098 B2
(45) Date of Patent: Nov. 27, 2018

(54) SEALED LED LIGHT MODULE

(71) Applicant: LUNUX GMBH, Laatzen (DE)

(72) Inventors: Mark Jelinek, Lippstadt (DE); Reinhold Brummel, Anröchte (DE); Horst Feldkamp, Lippstadt (DE); Alexander Kerpe, Lippstadt (DE)

(73) Assignee: LUNUX GMBH, Laatzen (DE)

( * ) Notice: Subject to any disclaimer, the term of this patent is extended or adjusted under 35 U.S.C. 154(b) by 0 days.

(21) Appl. No.: 14/610,634

(22) Filed: Jan. 30, 2015

(65) Prior Publication Data

US 2015/0138771 A1 May 21, 2015

Related U.S. Application Data

(63) Continuation of application No. PCT/EP2013/065806, filed on Jul. 26, 2013.

(30) Foreign Application Priority Data

Aug. 1, 2012 (EP) ..... 12178841

(51) Int. Cl.
*F21V 31/00* (2006.01)
*F21V 23/00* (2015.01)
(Continued)

(52) U.S. Cl.
CPC ..... *F21V 31/005* (2013.01); *F21K 9/00* (2013.01); *F21K 9/20* (2016.08); *F21V 3/00* (2013.01); *F21V 15/01* (2013.01); *F21V 19/005* (2013.01); *F21V 23/002* (2013.01); *F21V 23/009* (2013.01); *F21V 23/06* (2013.01); *F21Y 2115/10* (2016.08)

(58) Field of Classification Search
None
See application file for complete search history.

(56) References Cited

U.S. PATENT DOCUMENTS 3,551,669 A 12/1970 Muller
5,632,551 A 5/1997 Roney et al.
(Continued)

FOREIGN PATENT DOCUMENTS

DE 102 41 941 3/2004
DE 20 2006 003 729 6/2006
(Continued)

OTHER PUBLICATIONS

Search Report and Written Opinion issued in International Application No. PCT/EP2013/065806 dated Oct. 4, 2013.
(Continued)

*Primary Examiner* — Sharon Payne
(74) *Attorney, Agent, or Firm* — Norton Rose Fulbright US LLP

(57) ABSTRACT

A sealed LED light module comprises a base plate, having at least one LED, and a cover providing a base plate support. The base plate is located on the cover to define an inner space which is sealed against the environment. For sealing the cover has at least one sidewall, which defines a trench together with at least one base plate support, and the trench holds a seal which interacts with at least one edge of the base plate and the surface of the trench to seal the inner space against the environment.

21 Claims, 4 Drawing Sheets

(51) Int. Cl.

| | |
|---|---|
| ***F21V 3/00*** | (2015.01) |
| ***F21K 9/00*** | (2016.01) |
| ***F21V 15/01*** | (2006.01) |
| ***F21V 19/00*** | (2006.01) |
| ***F21V 23/06*** | (2006.01) |
| ***F21K 9/20*** | (2016.01) |
| *F21Y 115/10* | (2016.01) |

(56) References Cited

U.S. PATENT DOCUMENTS

| | | | | |
|---|---|---|---|---|
| 6,837,598 | B2 * | 1/2005 | Marcus | F21S 8/032 362/235 |
| 7,374,322 | B2 * | 5/2008 | Steen | B60Q 1/302 362/487 |
| 7,429,186 | B2 | 9/2008 | Mrakovich et al. | |
| 8,235,549 | B2 * | 8/2012 | Gingrich, III | F21V 15/01 362/249.02 |
| 2002/0137374 | A1 | 9/2002 | O'Rourke et al. | |
| 2004/0184264 | A1 | 9/2004 | Elam et al. | |
| 2006/0262545 | A1 | 11/2006 | Piepgras et al. | |
| 2009/0109677 | A1 * | 4/2009 | Coushaine | F21L 4/00 362/267 |
| 2009/0268435 | A1 | 10/2009 | Mandy et al. | |
| 2009/0310363 | A1 | 12/2009 | Liu et al. | |
| 2012/0188766 | A1 | 7/2012 | Lu et al. | |
| 2015/0029731 | A1 | 1/2015 | Jelinek et al. | |

FOREIGN PATENT DOCUMENTS

| | | |
|---|---|---|
| DE | 10 2010 042 264 | 4/2012 |
| EP | 1182396 | 2/2002 |
| EP | 1293724 | 3/2003 |
| EP | 2086065 | 8/2009 |
| EP | 2088368 | 8/2009 |
| EP | 2151899 | 2/2010 |
| EP | 2 317 205 | 5/2011 |
| EP | 2317205 | 5/2011 |
| EP | 2650607 | 10/2013 |
| JP | 2008-258066 | 10/2008 |
| JP | 2008-305807 | 12/2008 |
| JP | 2010-287312 | 12/2010 |
| JP | 2012-181944 | 9/2012 |
| WO | WO 2001/091249 | 11/2001 |
| WO | WO 2006/127666 | 11/2006 |
| WO | WO/11/017901 | 2/2011 |
| WO | WO 2011/017901 | 2/2011 |
| WO | WO 2011/144689 | 11/2011 |
| WO | WO/12/041638 | 4/2012 |
| WO | WO 2012/041638 | 4/2012 |
| WO | WO 2011/122518 | 7/2013 |

OTHER PUBLICATIONS

Communication under Rule 71(3) EPC in European Application No. 12 178 841.8 dated Feb. 13, 2015 and Examiner Amendments printed Jan. 30, 2014.

* cited by examiner

SEALED LED LIGHT MODULE

PRIORITY CLAIM

This application is a continuation of pending International Application No. PCT/EP2013/065806 filed on Jul. 26, 2013, which designates the United States and claims priority from European Application No. 12178841.8 filed on Aug. 1, 2012, both of which are incorporated herein by reference in their entireties.

BACKGROUND OF THE INVENTION

1. Field of the Invention

The invention relates to a LED (Light Emitting Diode) light unit and specifically to a housing for a LED light unit.

2. Description of Relevant Art

In LED light units, a plurality of LEDs may be mounted to a printed circuit board. This circuit board is often covered by a cover which may also act as a lens for guiding light to the outside of the light unit.

The European patent application publication EP 1 821 030 A1 discloses a LED light unit, where LEDs are mounted to a heat sink. Furthermore, the LEDs are embedded by a cover element and a housing to form an integral part which is water-tight.

US 2012/0188788 A1 discloses a LED-light assembly. The LED light assembly has a housing with a transparent front cover being screwed to a back cover. A sealant may be inserted in an annular through between the front cover and the back covering after the screws have been fastened. At the rear side of the back cover are fins rendering the back cover into a heat sink. The housing accommodates a printed circuit board, the latter supporting LEDs.

A disadvantage of these LED light units is their respective complex and thus expensive design. With respect to EP 1 821 030 A1 the cover element embeds the LEDs which may affect optical characteristics.

SUMMARY OF THE INVENTION

The problem to be solved by the invention is to design a sealed LED light module which is sealed against dust, dirt, water and/or humidity, which has excellent long term stability and which can be manufactured by an automated process in large volumes at low costs.

The problem is solved by an embodiment with a base plate supporting at least one LED and/or further electronic components which may be required for driving/controlling the at least one LED. The base plate may be a printed circuit board. It may also comprise a printed circuit board. Preferably, the base plate is a heat conducting plate which may be made of a metal, like aluminum, and which further preferably comprises laminated electrically isolating and current-conducting structures. Preferably, the base plate is at least essential planar, as expressed in the word "plate". The base plate is positioned on a cover through which light may be emitted from the at least one LED to the outside of the light module. The cover may have at least one lens for guiding and/or directing the light emitted by the at least one LED. Preferably, the cover is made of a clear and/or transparent and/or semitransparent material, preferably a plastic material. The cover preferably has at least one base plate support. Such a base plate support may be a strut or a protrusion from the inner surface of the cover.

Preferably, the base plate support is a bar or a barrier, preferably surrounding at least a part of the base plate. It is further preferred, if the cover has at least one sidewall which forms a trench together with the at least one base plate support. Most preferably this trench is surrounding the baseplate and/or the cover.

At least one edge of the base plate, preferably all edges of an e.g. rectangular base plate are held within a sealing. The sealing seals a slit between the base plate and the cover and preferably fixes the base plate to the cover. In other words, the mechanical connection of the base and the cover is provided by said sealing. The base plate and the cover are so to speak attached to each other by said sealing. The sealing preferably is the only connecting means between the base plate and the cover. Accordingly there is no screw, rivet or clip in between or surrounding the base plate and the cover. The sealing may be a mold or cast or glue. It preferably is at least a semi-elastic plastic material. Preferably, the sealing is contained within the trench defined by at least one base plate support and a sidewall of the cover. Preferably the sealing is processed by low pressure injection molding. It may be a hot-melt which may be based on polyamide.

Preferably, the base plate and the cover form a hermetically sealed unit which preferably is water tight and which preferably cannot be opened and need not to be opened for service. This prevents the penetration of dust and debris into the optical system which also extends lifetime and improves quality. Most preferably the base plate has no further holes or openings except holes which are sealed and ventilation holes. Due to the elastic properties of the seal, different thermal expansion of the base plate and the cover may be equalized, therefore preventing cracks or even bending of the unit at extreme temperatures.

To easy assembly, the cover may be placed with its inside up on a flat surface. Then, the base plate may be placed on the cover. The base plate is preferably held at a correct distance to the cover by the at least one base plate support. There may be further notches or holes in the base plate, interacting with protrusions in the base plate support to ensure a correct location of the base plate on the cover. After placement of the base plate on the cover, sealing is filled and/or molded to the edges of the base plate, preferably filling the at least one trench. Here, the at least one trench may act as a molding form which holds the sealing when it is in a semi-liquid or liquid condition.

In a further preferred embodiment, there is at least one sealing sidewall located between the cover and the base plate for sealing the inner space between the cover and the base plate containing the at least one LED against the outer environment. The sealing sidewall may enclose an area within which a further hole or opening may be provided in the base plate and/or the cover. Such an opening may be used for contacting an electrical connector and/or for inserting a screw. The sealing sidewall may be extending from the cover and may be of the same material as the cover. In an alternative embodiment, the sidewall may be of a material which is the same as the sealing. There may be any combination of the sealings disclosed herein with a connector. Generally such a sealed opening prevents any debris or contamination from the connector to penetrate into the optical system.

In a further embodiment, there may be an upper sealing which further seals parts of the outer side of the base plate. This upper sealing preferably is of the same material as the first sealing. To simplify molding, it may be connected by at least one bar to the first sealing. The upper sealing may also extend from the outside of the base plate through the inner space between the base plate and the cover to the inner side of the cover, therefore also sealing the inner space against the environment.

In a further embodiment, there are cut-outs and/or protrusions at the edges of the base plate.

In another embodiment, the edges of the base plate are bent to further in-crease mechanical strength of the connection to the sealing and to increase the mechanical stability of the mechanical contact between the base plate and the sealing.

BRIEF DESCRIPTION OF THE DRAWINGS

In the following, the invention will be described by way of example, without limitation of the general inventive concept, on examples of embodiment and with reference to the drawings.

Figure 1:
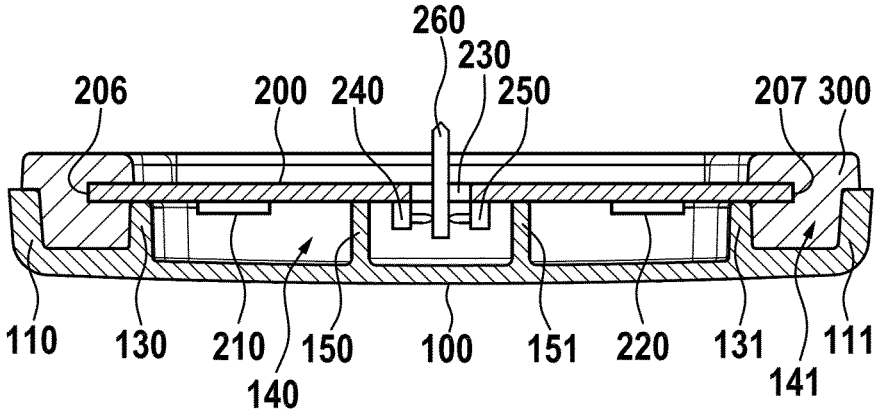
FIG. 1 shows a sectional view of the sealed LED light module.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

In FIG. 1, a sectional view of a first embodiment of the invention is shown. A cover 100 holds a base plate 200, whereas fixing and sealing between the cover and the base plate is done by a sealing 300. The base plate has an outer side (on top in the figure) and an inner side directed towards the cover, the inner side holds at least one LED (Light Emitting Diode) 210, 220, and optionally further electronic components. The LEDs radiate light from the bottom side through the cover 100 to the outside of the light module. For better holding of the base plate, preferably at least one base plate support 130, 131 are provided within the cover. They are preferably protruding from the surface of the cover. Furthermore, it is preferred, if the cover has at least one sidewall 110, 111, which preferably forms at least one trench 141 which may be filled with sealing 300 which preferably seals the edges 206, 207 of the base plate 200. Between the base plate 200 and the cover 100, there is a sealed inner space 140. Furthermore, there is at least one sealing sidewall 150, 151 between the cover 100 and the base plate 200. This at least one sealing sidewall encloses a section of the base plate which may contain an opening 230, through which a connecting plate 260 may penetrate to enter into electric contact with at least one electrical connector (240,250). By this way, electrical connection may be made from the LEDs at the base plate to an external power supply. In combination with an opening in the cover 100, which may be similar to opening 180 from FIG. 4, but with shortened inner walls, to allow access to the base plate 200, a connector may be inserted from the front side of the cover. This may allow external access e.g. for diagnosis or control like dimming of the lamp and/or the power supply. The connector may also be extending from the power supply though the base plate to be accessed from the front side of the cover. It is further preferred to have guiding elements for the connector at least in one of the cover, base plate or inner walls. Preferably these guiding elements allow insertion of the connector from at least one side, preferably from both sides.

Figure 2:
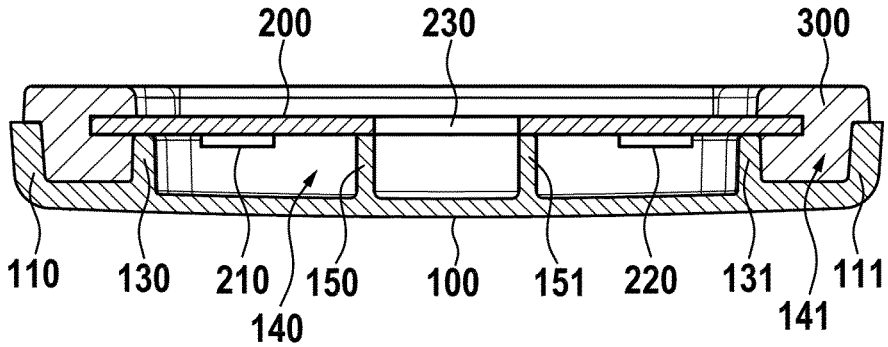
FIG. 2 shows a sectional view with sealing sidewalls extending from the cover to the surface of the base plate.

In FIG. 2, a further embodiment is disclosed. Herein, the opening in the base plate 230 is larger and may be used for a different purpose than inserting a connecting plate as disclosed before. In this embodiment, the sealing sidewalls preferably protrude from the cover 100 into the direction of the base plate 200 and end at the inner side of the base plate 200, which is bearing the at least one LED. It preferably comprises the same material as the cover 100.

Figure 3:
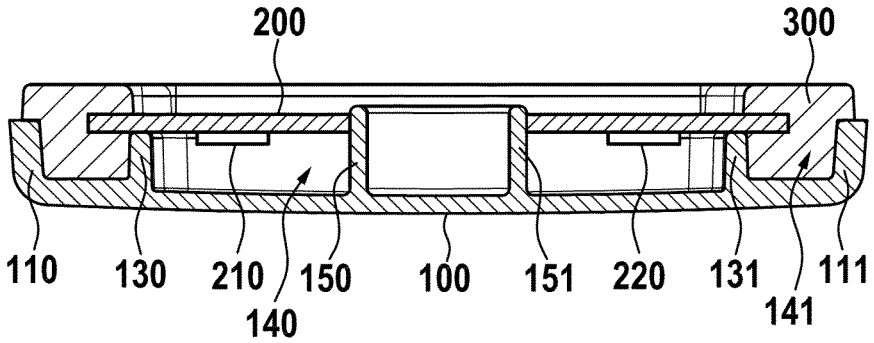
FIG. 3 shows a different embodiment of the sealing sidewall.

In FIG. 3, a different embodiment of sealing sidewalls 150, 151 is disclosed. Here, the sealing sidewalls 150, 151 protrude from the cover 100 to the outside of the base plate 200, therefore providing a better sealing of the base plate.

Figure 4:
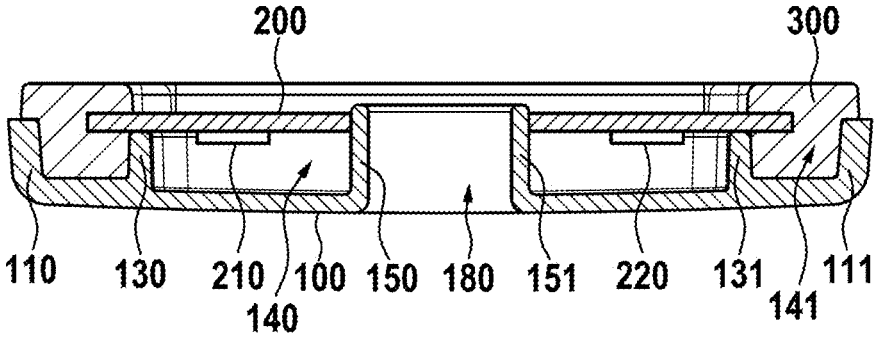
FIG. 4 shows an embodiment providing a cut-out in the cover.

In FIG. 4, a further embodiment is shown which provides an opening 180 in the cover. For this purpose, the sealing sidewalls 150, 151 extend from the cover 100 throughout the base plate 200. Contact of the sealing sidewalls may also be done as disclosed in FIG. 2. Such a cut-out in the cover may be used for gaining access to an electrical contact or to a screw.

Figure 5:
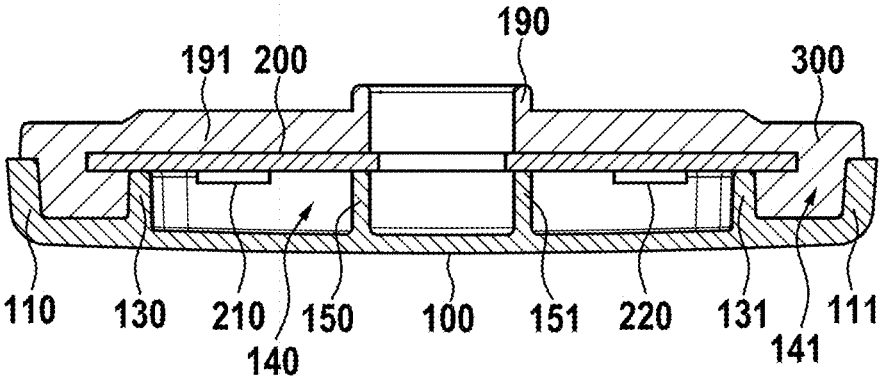
FIG. 5 shows an embodiment with an upper sealing to seal the outer side of the base plate.

In FIG. 5, a further embodiment is disclosed having an upper sealing 190 to seal an area at the rear side of the base plate 200. To simplify molding and to have a connection between the upper sealing which preferably is made of the same material as the sealing 300, at least one bar 191 may be provided. This kind of sealing may be combined with any other kind of sealing sidewalls disclosed before.

Figure 6:
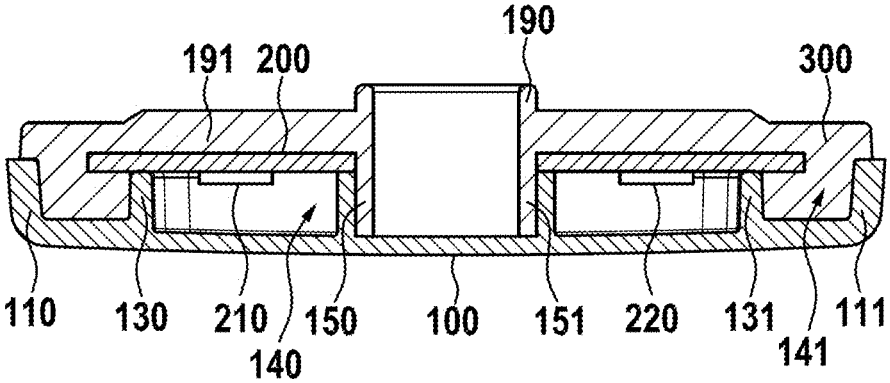
FIG. 6 shows a further sealing protruding to the cover.

In FIG. 6, a further sealing is disclosed which protrudes through the cover 100 and therefore seals or encapsulates the whole inner space.

Figure 7:
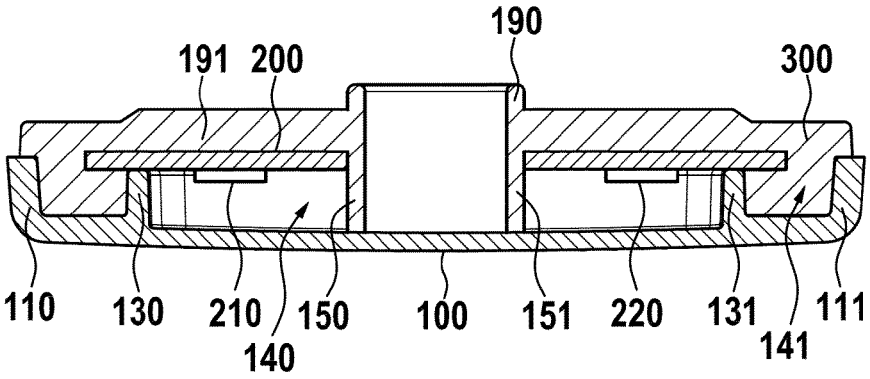
FIG. 7 shows a modified upper sealing protruding to the cover.

In FIG. 7, a modified upper sealing is disclosed which protrudes through the cover 100 and therefore seals or encapsulates the whole inner space.

Figure 8:
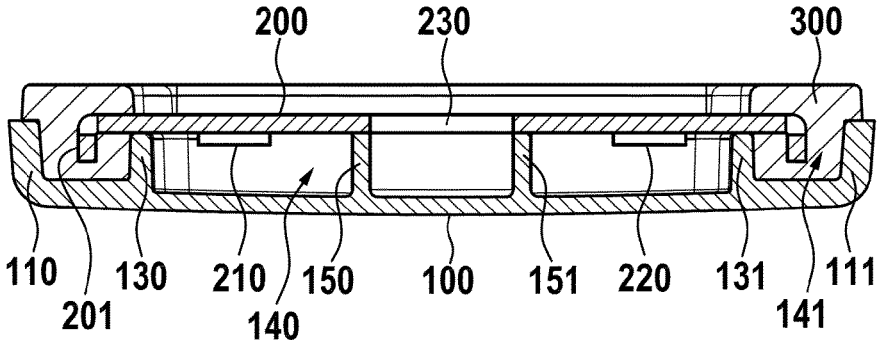
FIG. 8 shows an embodiment with a base plate having bent sidewalls is dis-closed.

In FIG. 8, a modified embodiment is disclosed. Herein, the base plate 200 has bent sidewalls 201. These bent sidewalls further increase mechanical stability and stiffness of the base plate. They further increase the mechanical retention force of the base plate within the sealing 300 and therefore within the cover 100, further increasing mechanical stability of the sealed LED light module. It is obvious that this specific embodiment may be combined with all other embodiments shown herein.

Figure 9:
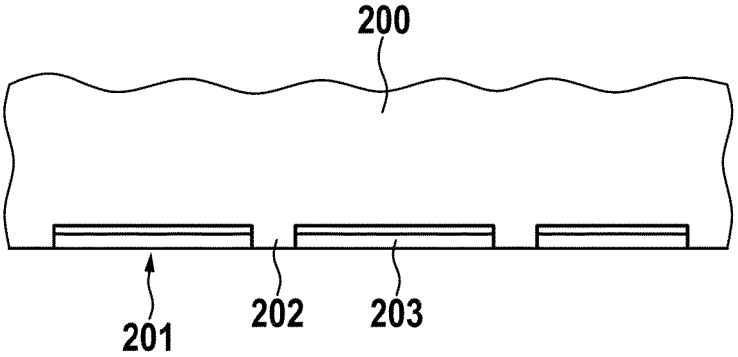
FIG. 9 shows an embodiment of bent sidewalls of the base plate.

In FIG. 9, a top view of a base plate 200 is shown. Herein, there are bars 202 connecting the bent sidewall 201 to the base plate 200. Between the bars, there are cut-outs 203. The sealing 300 penetrates through the cut-outs and therefore increases the retention of the base plate 200 within the sealing 300, further increasing mechanical stability. It is obvious that this specific embodiment may be combined with all other embodiments shown herein.

Figure 10:
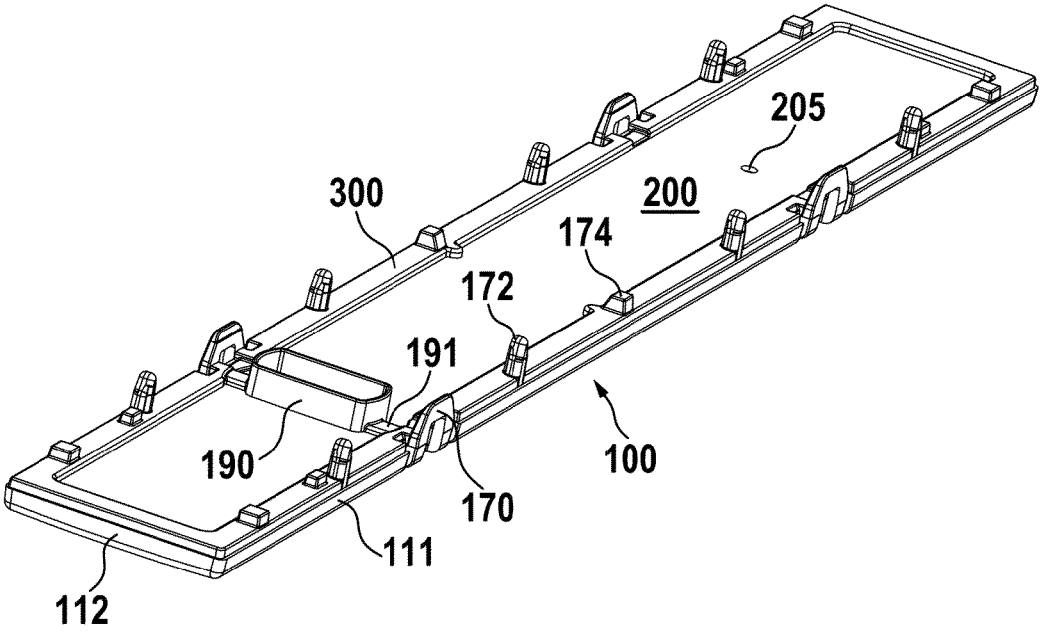
FIG. 10 shows a top view of the light module.

In FIG. 10, a top view of the light module is shown. The base plate 200 is placed on cover 100 and is sealed by sealing 300. Here, the second sidewall 111 and a third sidewall 112 can be seen. On top of the base plate 200, there is an upper sealing 190 connected by a bar 191 to the sealing 300. There may be a vent hole 205 in the base plate allowing for equalization of air pressure. This hole may have a filter, a membrane or other means for directing or selecting flow of vent exchange of gases, preferably preventing the intrusion of liquids or humidity. First protrusions 172 and second protrusions 174 may be provided for aligning the light module within a lamp case. Furthermore, it is preferred, if at least one clamp 170 is provided to fix the light module within a lamp case.

It will be appreciated to those skilled in the art having the benefit of this disclosure that this invention is believed to provide a sealed LED light module. Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

LIST OF REFERENCE NUMERALS

100 cover
110 first sidewall
111 second sidewall
112 third sidewall
130 first base plate support
131 second base plate support
140 inner space
141 trench
150 first sealing sidewall
151 second sealing sidewall
170 clamp
172 first protrusions
174 second protrusions
180 opening in cover
190 upper sealing
191 bar
200 base plate
201 bent sidewall
202 bar
203 cutout
205 vent hole
206, 207 edges of the base plate
210, 220 LEDs/components
230 opening in base plate
240 first connector
250 second connector
260 connecting plate
300 sealing

The invention claimed is:

1. Sealed light emitting diode (LED) light module comprising at least:

a base plate, comprising a printed circuit board (PCB) supporting at least one LED, and a transparent or semi-transparent, single-piece cover including a first portion configured to transmit light from the at least one LED, a second portion around and extending laterally outward from the first portion, at least one base plate support descending from the second portion, and at least one sidewall spaced from the at least one base plate support and descending from the second portion such that the at least one base plate support and the at least one sidewall define opposing sides of a trench, wherein the base plate is configured to be coupled to the cover to define an inner space between the base plate and the cover such that the LED is disposed in the inner space, and wherein the trench holds a peripheral seal that interacts with at least one edge of the base plate and a surface of the cover within the trench to seal the inner space against the environment and to fix the base plate to the cover, and wherein the peripheral seal comprises a molded, cast, or adhesive material.

2. Sealed LED light module according to claim 1, further comprising:

at least one sealing sidewall configured such that, when the base plate is coupled to the cover, the at least one sealing sidewall extends between an inner surface of the cover and an inner surface of the base plate around an opening in the base plate through which a connection can be made, and thereby further seal the inner space against the environment.

3. Sealed LED light module according to claim 2, wherein the opening in the base plate is configured to receive a connection plate of a connector in contact with at least one electrical connector of the sealed LED light module.

4. Sealed LED light module according to claim 1, further comprising:

at least one sealing sidewall configured such that, when the base plate is coupled to the cover, the at least one sealing sidewall extends between an inner surface of the cover and an inner surface of the base plate around an opening in the cover through which a connection can be made, and thereby further seal the inner space against the environment.

5. Sealed LED light module according to claim 4, wherein the opening in the cover is configured to receive a connection plate of a connector in contact with at least one electrical connector of the sealed LED light module.

6. Sealed LED light module according to claim 1, wherein a portion of the at least one sidewall is angled relative to another portion of the at least one sidewall, and the inner space is defined by at least a portion of a surface of the base plate, the surface of the cover, and the at least one base plate support.

7. Sealed LED light module according to claim 6, wherein:

the at least one sidewall is in contact with a first surface of the base plate, the cover includes at least one second sidewall spaced from the at least one base plate support descending from the first portion and in contact with the base plate, and the inner space is defined by the first surface of the base plate, an inner surface of the cover, the at least one base plate support, and the ate least one second sidewall.

8. Sealed LED light module according to claim 1, further comprising:

a sealing structure including the peripheral seal, a sealing bar, and a sealing sidewall in contact with an inner surface of the cover, wherein:

the sealing bar is in contact with a first surface of the base plate and is coupled to the peripheral seal and the sealing sidewall, the inner space is defined by the sealing sidewall, the inner surface of the cover, and a second surface of the base plate that is opposite the first surface, and the sealing sidewall extends from the sealing bar in a first direction that is opposite to a second direction in which the at least one base plate support descends from the second portion.

9. Sealed LED light module according to claim 1, wherein an upper seal is provided to seal an outer surface of the base plate, and the upper seal is of the same material as the peripheral seal and is connected by at least one bar to the peripheral seal.

10. Sealed LED light module according to claim 1, where the peripheral seal extends into the trench and over portions of each of upper, lower, and edge surfaces of the base plate.

11. Sealed light emitting diode (LED) light module comprising at least:

a base plate, comprising a printed circuit board (PCB) supporting at least one LED, and a transparent or semi-transparent cover including a first portion configured to transmit light from the at least one LED, a second portion around and extending laterally outward from the first portion, at least one base plate support descending from the second portion, and at least one sidewall spaced from the at least one base plate support and descending from the second portion, where the at least one base plate support and at least one sidewall are unitary with the cover and cooperate to define opposing sides of a trench, wherein the base plate is configured to be coupled to the cover to define an inner space between the base plate and the cover such that the LED is disposed in the inner space, and wherein the trench holds a peripheral seal that interacts with at least one edge of the base plate and a surface of the cover within the trench to seal the inner space against the environment and to fix the base plate to the cover, and wherein the peripheral seal comprises a molded, cast, or adhesive material.

12. Sealed LED light module according to claim 11, further comprising:

at least one sealing sidewall configured such that, when the base plate is coupled to the cover, the at least one sealing sidewall extends between an inner surface of the cover and an inner surface of the base plate around an opening in the base plate through which a connection can be made, and thereby further seal the inner space against the environment.

13. Sealed LED light module according to claim 12, wherein the opening in the base plate is configured to receive a connection plate of a connector in contact with at least one electrical connector of the sealed LED light module.

14. Sealed LED light module according to claim 11, further comprising:

at least one sealing sidewall configured such that, when the base plate is coupled to the cover, the at least one sealing sidewall extends between an inner surface of the cover and an inner surface of the base plate around an opening in the cover through which a connection can be made, and thereby further seal the inner space against the environment.

15. Sealed LED light module according to claim 14, wherein the opening in the cover is configured to receive a connection plate of a connector in contact with at least one electrical connector of the sealed LED light module.

16. Sealed LED light module according to claim 11, wherein a portion of the at least one sidewall is angled relative to another portion of the at least one sidewall.

17. Sealed LED light module according to claim 16, wherein the angled portion of the at least one sidewall is connected to the base plate by at least one bar and the at least one sidewall includes a plurality of bars and at least one cut-out between neighboring bars.

18. Sealed LED light module according to claim 11, wherein an upper seal is provided to seal an outer surface of the base plate.

19. Sealed LED light module according to claim 18, wherein the upper seal is of the same material as the peripheral seal and is connected by at least one bar to the peripheral seal.

20. Sealed LED light module according to claim 11, where the peripheral seal extends into the trench and over portions of both upper and lower surfaces of the base plate.

21. Sealed light emitting diode (LED) light module comprising at least:

a base plate, comprising a printed circuit board (PCB) supporting at least one LED, and a transparent or semi-transparent cover having a first side and a second side, the second side of the cover including a first portion configured to transmit light from the at least one LED, a second portion around and extending laterally outward from the first portion, at least one base plate support descending from the second portion, and at least one sidewall spaced from the at least one base plate support and descending from the second portion such that the at least one base plate support and at least one sidewall define opposing sides of a trench, disposed on the second side of the cover, that opens away from the first side of the cover, wherein the base plate is configured to be coupled to the cover to define an inner space on the second side of the cover between the base plate and the cover such that the LED is disposed in the inner space, the inner space located adjacent to and defined by a first side of the at least one base plate support and the trench located adjacent to and defined by a second side of the at least one base plate support, and wherein the trench holds a peripheral seal that interacts with at least one edge of the base plate and a surface of the cover within the trench to seal the inner space against the environment and to fix the base plate to the cover, and wherein the peripheral seal comprises a molded, cast, or adhesive material.

* * * * *